US006204481B1

(12) United States Patent
Ito

(10) Patent No.: US 6,204,481 B1
(45) Date of Patent: Mar. 20, 2001

(54) GLOW PLUG WITH CERAMIC HEATING ELEMENT HAVING ELECTRODE ATTACHED THERETO

(75) Inventor: Tsuneo Ito, Nagoya (JP)

(73) Assignee: NGK Spark Plug Co., Ltd., Aichi-ken (JP)

( * ) Notice: Subject to any disclaimer, the term of this patent is extended or adjusted under 35 U.S.C. 154(b) by 0 days.

(21) Appl. No.: 09/392,745

(22) Filed: Sep. 9, 1999

(30) Foreign Application Priority Data

Sep. 11, 1998 (JP) ..... 10-257729

(51) Int. Cl.[7] ..... F23Q 7/00
(52) U.S. Cl. ..... 219/270; 123/145 A
(58) Field of Search ..... 219/270, 544, 219/541; 123/145 A, 145 R; 361/264–266

(56) References Cited

U.S. PATENT DOCUMENTS

| | | | | |
|---|---|---|---|---|
| 4,475,029 | * | 10/1984 | Yoshida et al. | 361/266 |
| 4,912,305 | | 3/1990 | Tatemasu et al. . | |
| 5,264,681 | | 11/1993 | Nozaki et al. . | |
| 5,519,187 | * | 5/1996 | Hinkle | 219/270 |
| 5,852,280 | * | 12/1998 | Mizuno | 219/270 |
| 5,880,432 | * | 3/1999 | Radmacher | 219/270 |
| 5,998,765 | * | 12/1999 | Mizuno et al. | 219/270 |

FOREIGN PATENT DOCUMENTS

| | | | | |
|---|---|---|---|---|
| 3918964 | | 12/1989 | (DE) . | |
| 4204288 | | 10/1995 | (DE) . | |
| 62-158926 | * | 7/1987 | (JP) | 219/270 |
| 7-6865 | * | 1/1995 | (JP) . | |
| 7-71756 | | 3/1995 | (JP) . | |
| 7-282960 | * | 10/1995 | (JP) . | |
| 8-339882 | * | 12/1996 | (JP) . | |
| 9-184623 | | 7/1997 | (JP) . | |
| 9-184625 | * | 7/1997 | (JP) . | |

* cited by examiner

*Primary Examiner*—John A. Jeffery
(74) *Attorney, Agent, or Firm*—Finnegan, Henderson, Farabow, Garrett & Dunner, L.L.P.

(57) ABSTRACT

A ceramic heater includes a cylindrical member; a ceramic heating member, which is disposed within the cylindrical member such that an end portion thereof is projected from an end of the cylindrical member; and a metallic shell, which surrounds the cylindrical member. The ceramic heating member includes a ceramic body and a U-shaped conductive ceramic element, which is embedded in an end portion of the ceramic body. A direction-changing portion of the conductive ceramic element generates heat through electrical resistance when electricity is supplied to the conductive ceramic element through electrodes connected to the end portions of the conductive ceramic element. The electrodes are disposed such that the distance L between the ends of the electrodes and the end of the metallic shell satisfies the expression $L \leqq 1$ mm, where the distance L is considered negative when the ends of the electrodes are located within the metallic shell.

17 Claims, 7 Drawing Sheets

GLOW PLUG WITH CERAMIC HEATING ELEMENT HAVING ELECTRODE ATTACHED THERETO

BACKGROUND OF THE INVENTION

1. Field of the Invention

The present invention relates to a ceramic heater that can be used to help start diesel engines, wherein the heater includes a ceramic heating member.

2. Description of the Related Art

FIG. 7A shows a conventionally known ceramic heater 100, which can aid in the starting of a diesel engine. As shown in FIG. 7A, the conventional ceramic heater 100 includes a metallic cylindrical member 101 and a ceramic heating element 102, which is held at an end portion of the cylindrical member 101. The ceramic heating member 102 includes an insulating ceramic body 103 having a bar shape; a conductive ceramic element 104 having a U-shape, which is embedded in an end portion of the insulating ceramic body 103; and electrodes 105, which are embedded and thus connected to the respective end portions of the conductive ceramic element 104. Upon being supplied with electricity by means of the electrodes 105, the conductive ceramic element 104 generates heat through electrical resistance.

In the above-described ceramic heater 100, the cylindrical member 101 repeatedly expands and contracts from the heat generated by resistive heating of the ceramic heating element 102 as well as from repeated heating and cooling during combustion of the engine. As a result, a compressive stress is repeatedly exerted on the ceramic heating element 102. This compressive stress tends to become excessively large at an end portion 101*a* of the cylindrical member 101, since the end portion is more likely to be subjected to heat generated by the conductive ceramic element 104 and heat radiated from the engine. End portions 104*a* of the conductive ceramic element 104, where the respective electrodes 105 are embedded, are located within the end portion 101*a*. As shown in FIG. 7B, due to a difference in thermal expansion coefficient between the electrode 105 and the conductive ceramic element 104, a fine defect, such as a gap 105*a*, may form in the boundary there-between during cooling such as would occur after firing. When the above-mentioned compressive force is exerted on such a defective region, a crack may develop in the conductive ceramic element 104, potentially shortening the life of the conductive ceramic element 104.

At the same time, in order to meet the recent tightening of exhaust gas regulations and to improve fuel consumption ratio, employment of a direct injection system in a diesel engine is rapidly becoming common practice. Thus, there is also a need for increasing the distance between the end of a seat surface and the end of a ceramic heating member by at least 5 mm longer compared with a ceramic heating member used in a swirl-chamber type diesel engine. However, the longer projection of the ceramic heating member into a combustion chamber inevitably leads to thermally induced stress and thus cracking, which may not be sufficiently suppressed simply by disposing within the cylindrical member 101 the boundary between the electrode 105 and the conductive ceramic element 104.

SUMMARY OF THE INVENTION

An object of the present invention is to provide a ceramic heater whose conductive ceramic element exhibits excellent durability. To achieve this object, the present invention provides a ceramic heater comprising a metallic shell which is attached to a structural body such that a seat surface located on an end portion thereof abuts the structural body. The present ceramic heater also comprises a ceramic heating member which is disposed within the metallic shell such that an end portion thereof is projected from an end face of the metallic shell.

The present ceramic heating member, therefore, comprises a ceramic body, a conductive ceramic element, and two electrodes. The conductive ceramic element is embedded in a portion of the ceramic body corresponding to the end portion of the ceramic heating member. The two electrodes are connected to the conductive ceramic element such that one end of one electrode is embedded in one end of the conductive ceramic element, and one end of the other electrode is embedded in the other end of the conductive ceramic element. Electricity is applied to the conductive ceramic element by means of the electrodes so that the conductive ceramic element generates heat through electrical resistance. The conductive ceramic element may include a U-shaped portion for carrying electrical current. This portion, which is referred to as a direction-changing portion, extends from one base end thereof and changes directions to extend to the other base end thereof and contains two straight portions, which extend in the same direction from the corresponding ends of the direction-changing portion. The conductive ceramic element is disposed such that the direction-changing portion corresponds to the end portion of the ceramic heating member.

The distance L between the ends of the electrodes embedded in the conductive ceramic element and the end of the seat surface of the metallic shell is set so as to satisfy the expression $L \leqq 1$ mm, where the distance L is considered negative when the ends of the electrodes are located within the metallic shell. More preferably, the distance L is set so as to satisfy the expression $L \leqq 0$ mm.

By maintaining the distance L as described above, resistive-induced heat, i.e., heat that is generated in an interface portion between the electrode and the conductive ceramic from the electricity that is applied to the conductive ceramic element, can be released effectively to the structural body. As a result, cracking in the conductive ceramic element which would otherwise result from the aforementioned compressive stress is effectively prevented or suppressed.

Preferably, the ceramic heater further comprises a cylindrical member which is interposed between the ceramic heating member and the metallic shell and is projected from the end of the seat surface of the metallic shell. As a result, the interface portion between the electrode and the conductive ceramic element is located apart from an end portion of the cylindrical member, which can expand and contract due to the increased temperatures resulting from resistive heat and heat radiated from the engine. Accordingly, the compressive stress induced by expansion/contraction of the cylindrical member is hardly exerted on the interface portion.

The effect of the present invention becomes remarkable when the end of the ceramic heating member is located at least 20 mm apart from the end of the seat surface of the metallic shell. In this case, heat generated by electrical resistance in the ceramic heating member and radiated from the engine becomes more difficult to release to the structural body through the cylindrical member.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

Figure 1:
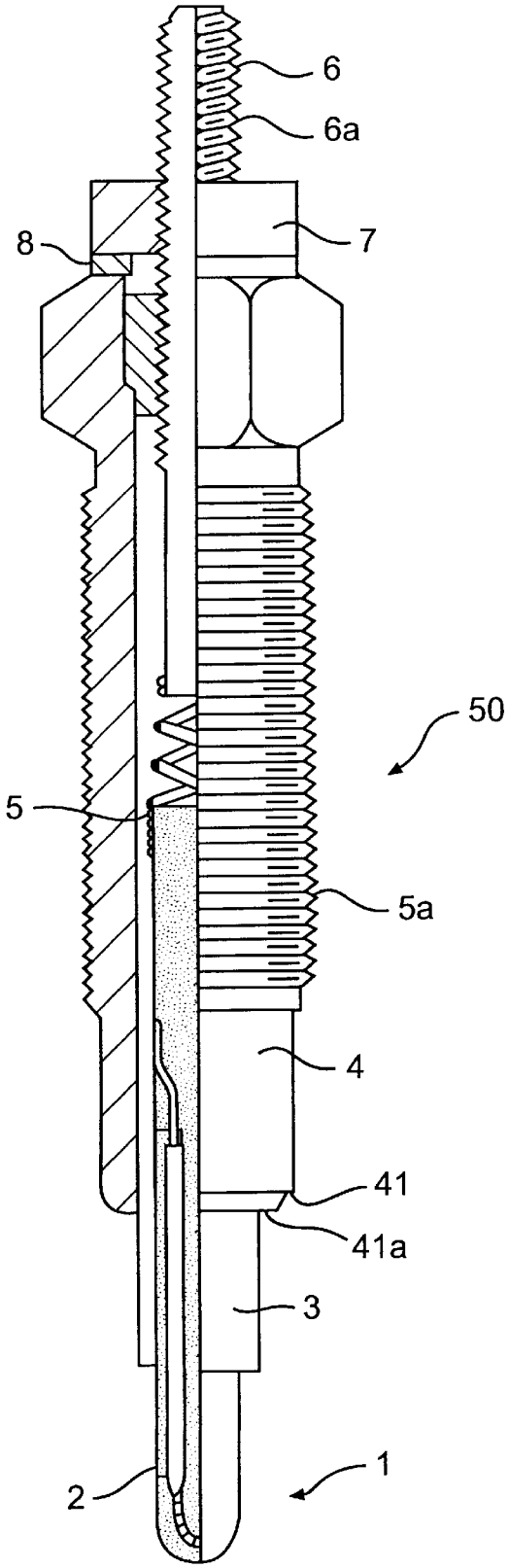
FIG. 1 is a partially sectional view showing a ceramic heater according to an embodiment of the present invention.

An embodiment of the present invention will next be described with reference to the drawings. FIG. 1 shows the internal structure as well as external view of a ceramic heater 50 according to the embodiment. As shown in FIG. 1, the ceramic heater 50 includes a ceramic heating member 1 provided at one end thereof, a metallic cylindrical member 3 that surrounds the ceramic heating member 1 while an end portion 2 of the ceramic heating member 1 is projected therefrom, and a cylindrical metallic shell 4 that surrounds the cylindrical member 3. The ceramic heating member 1 and the cylindrical member 3 are brazed together, and the cylindrical member 3 and the metallic shell 4 are brazed together. A connection member 5 is made of a metallic wire such that the opposite end portions thereof are each formed into a coil spring. One coiled end portion of the connection member 5 is fitted onto a rear end portion of the ceramic heating member 1 (the term "rear" corresponds to the upper end of FIG. 1), whereas the other coiled end portion is fitted onto one end portion of a metallic shaft 6, which is inserted into the metallic shell 4. The other end portion of the metallic shaft 6 extends toward the exterior of the metallic shell 4 and assumes the form of a screw portion 6*a*, with which a nut 7 engages. By tightening the nut 7 toward the metallic shell 4, the metallic shaft 6 is fixedly attached the metallic shell 4. An insulating bushing 8 is interposed between the nut 7 an the metallic shell 4. Screw threads 5*a* are formed on the outer surface of the metallic shell 4 and are adapted to fixedly attach the ceramic heater 50 onto an unillustrated engine block. A seat surface 41 is formed on a front end of the metallic shell 4 and abuts the engine block so as to seal a combustion chamber (the term "front" corresponds to the lower end of FIG. 1). The seat surface 41 is also adapted to release resistance heat generated by the ceramic heater 50 and heat radiated from an engine.

Figure 2:
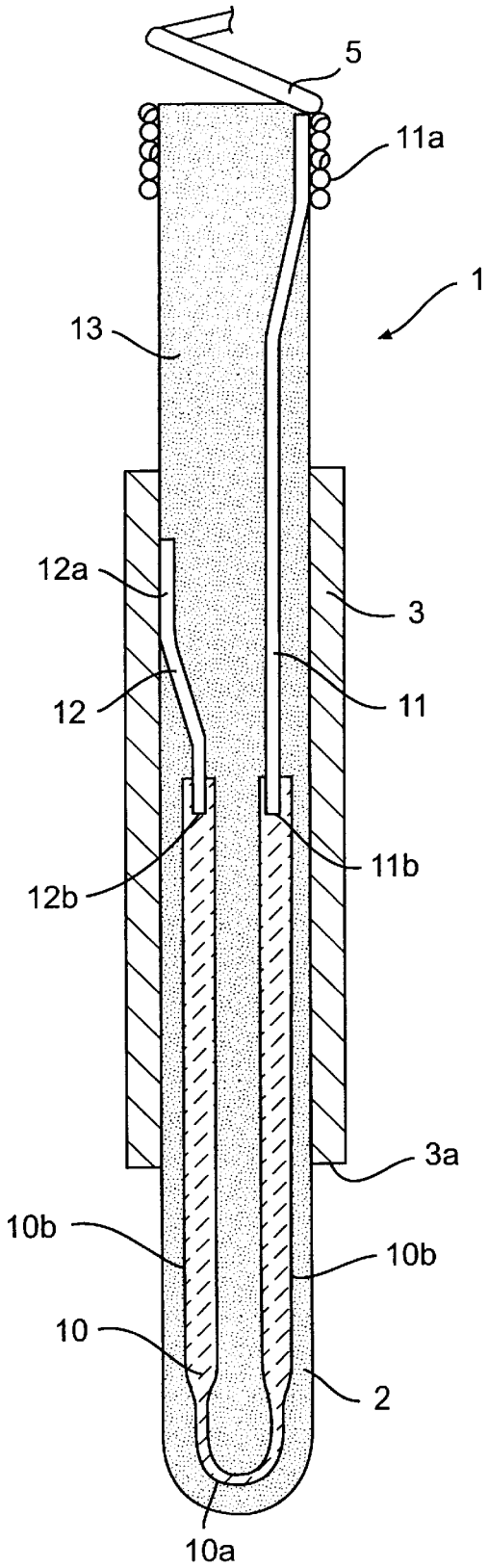
FIG. 2 is a sectional view showing a ceramic heating member of the ceramic heater of FIG. 1.

As shown in FIG. 2, the ceramic heating member 1 includes a conductive ceramic element 10 having the shape of the letter U. The conductive ceramic element 10 includes a direction-changing portion 10*a* which extends from one base end thereof and changes directions to extend to the other base end thereof and two straight portions 10*b*, which extend in the same direction from the corresponding base ends of the direction-changing portion 10*a*. Front end portions of electrodes 11 and 12 having the form of a thread or rod are embedded in the corresponding end portions of the conductive ceramic element 10. The conductive ceramic element 10 is housed within a ceramic body 13 which has a substantially circular cross section such that the direction-changing portion 10*a* is located at a position corresponding to the end portion 2 of the ceramic heating member 1. The cross-sectional area of the direction-changing portion 10*a* is rendered smaller than that of the straight portion 10*b* so as to generate heat at the direction-changing portion 10*a* (i.e., at the end portion 2 of the ceramic heating member 1). In one embodiment, the direction-changing portion 10*a* and the straight portion 10*b* may have the identical cross-sectional area.

Figure 3:
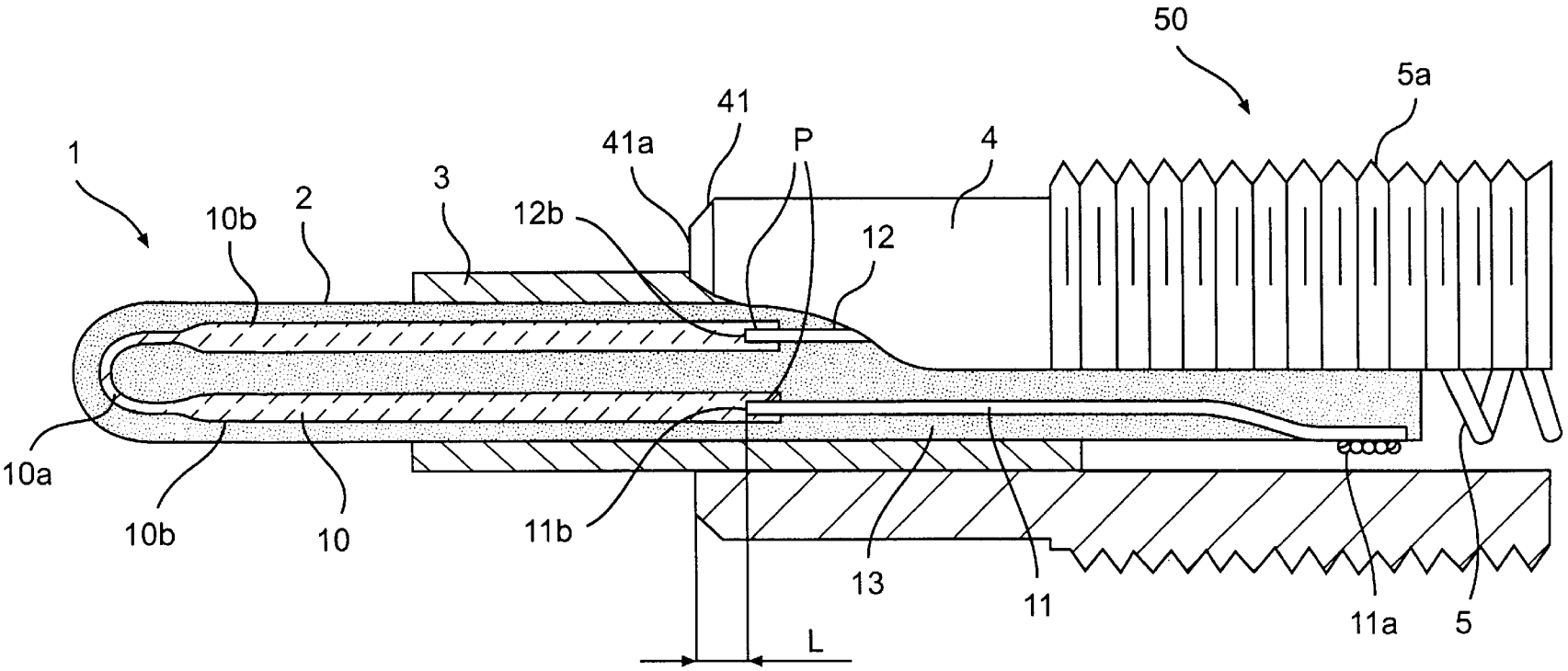
FIG. 3 is a partially sectional view showing the positional relationship between the ceramic heating member and a cylindrical member in the ceramic heater of FIG. 1.

The electrodes 11 and 12 extend within the ceramic body 13 away from the conductive ceramic element 10. A rear end portion of the electrode 12 is exposed at the surface of the ceramic body 13 and within the cylindrical member 3 and assumes the form of an exposed portion 12*a*, whereas a rear end portion of the electrode 11 is exposed at the surface of the ceramic body 13 and in the vicinity of a rear end portion of the ceramic body 13 and assumes the form of an exposed portion 11*a*. As shown in FIG. 3, the distance L between an end 11*b* (12*b*) of the electrode 11 (12) and an end 41*a* of the seat surface 41 is set so as to satisfy the expression $L \leqq 1$ mm, preferably $L \leqq 0$ mm, where the distance L is considered negative when the end 11*b* (12*b*) is located within the metallic shell 4.

The conductive ceramic element 10 is made of a conductive ceramic, such as tungsten carbide (WC), molybdenum silicide ($MoSi_2$ or $Mo_5Si_3$), or a composite of tungsten carbide and silicon nitride ($Si_3N_4$). Also, a semiconductor ceramic, such as silicon carbide, may be used as a material for the conductive ceramic element 10. The electrodes 11 and 12 are made of a metal having a high melting point, such as tungsten (W) or a tungsten-rhenium (Re) alloy. The ceramic body 13 is mainly made of an insulating ceramic, such as alumina ($Al_2O_3$), silica ($SiO_2$), zirconia ($ZrO_2$), titania ($TiO_2$), magnesia (MgO), mullite ($3Al_2O_3 \cdot 2SiO_2$), zircon ($ZrO_2 \cdot SiO_2$), cordierite ($2MgO \cdot 2Al_2O_3 \cdot 5SiO_2$), silicon nitride ($Si_3N_4$), or aluminum nitride (AlN).

In FIG. 2, a thin metallic layer of, for example, nickel (not shown) is partially formed on the surface of the ceramic body 13 in such a manner as to cover the exposed portion 12*a* of the electrode 12 by, for example, plating or vapor phase growth process. The thus-formed thin metallic layer and the cylindrical member 3 are brazed together, thereby establishing the electrical connection between the electrode 12 and the cylindrical member 3. Similarly, the thin metallic layer is partially formed on the surface of the ceramic body 13 in such a manner as to cover the exposed portion 11*a* of the electrode 11. The connection member 5 is brazed to the thus-formed thin metallic layer, thereby establishing the electrical connection between the electrode 11 and the connection member 5. Accordingly, electricity is supplied from an unillustrated power source to the conductive ceramic element 10 through the metallic shaft 6 (FIG. 1), the connection member 5, and the electrode 11. Also, the conductive ceramic element 10 is grounded through the electrode 12, the cylindrical member 3, the metallic shell 4 (FIG. 1), and the unillustrated engine block. The conductive ceramic element 10 is thus supplied with electricity and generates heat through electrical resistance.

As shown in FIG. 3, the end 11*b* (12*b*) of the electrode 11 (12) is located such that an interface portion P between the electrode 11 (12) and the conductive ceramic element 10 is positioned away from an end portion of the cylindrical member 3, which is likely to expand and contract due to heat generated by the ceramic heating member 1 and heat radiated from an engine. Accordingly, the interface portions P are less likely to be subjected to a compressive stress induced by such thermal expansion and contraction of the cylindrical member 3. Further, since the interface portions P are located in the vicinity of the seat surface 41 of the metallic shell 4, heat generated by the ceramic heating member 1 and heat radiated from an engine can be effectively released to the engine block. As a result, cracking can be prevented or suppressed which would otherwise occur in the conductive ceramic element 10 in the vicinity of the interface portions P.

Figure 4A:
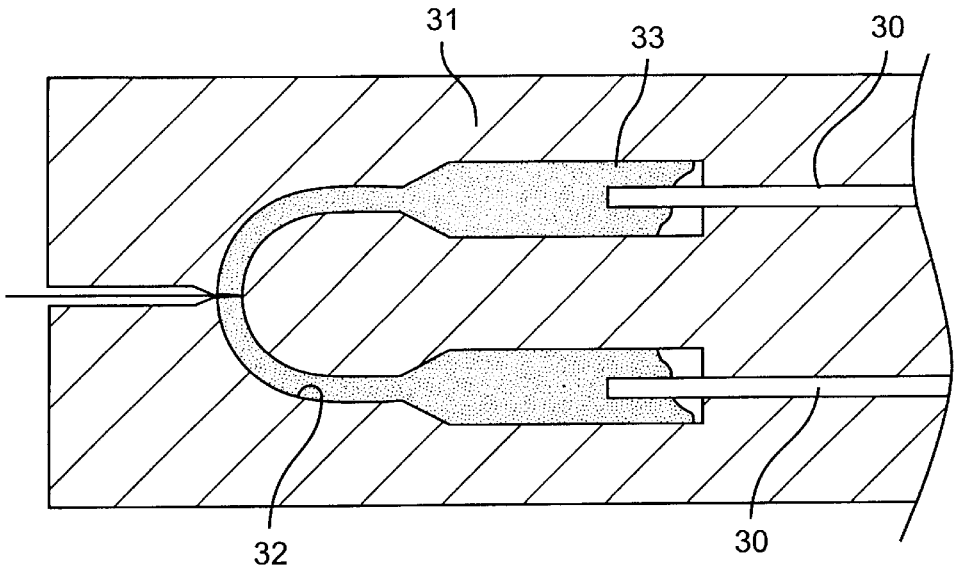
FIG. 4A is a sectional view showing a step of forming a conductive ceramic element through injection compaction.
Figure 4B:
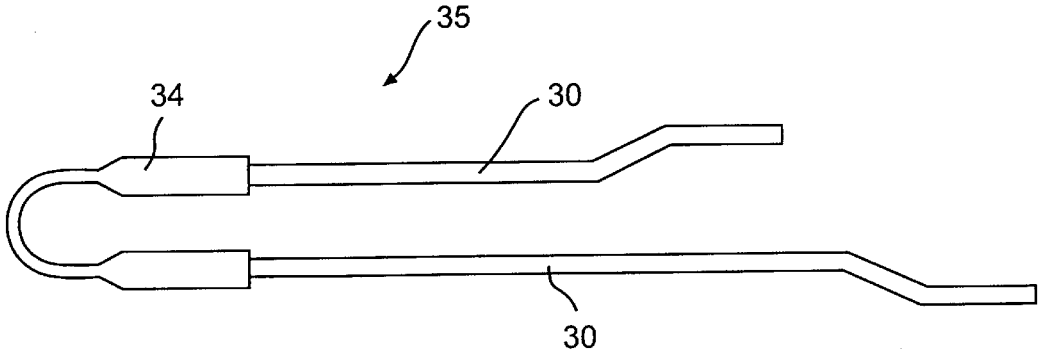
FIG. 4B is a view showing an integral injection compact obtained through injection compaction of FIG. 4A.

The ceramic heating member 1 can be manufactured by, for example, the following method. As shown in FIG. 4A, electrode materials 30 are disposed in a die 31 such that end portions thereof are inserted into a cavity 32 formed in the die 31. The cavity 32 is formed in the shape of the letter U corresponding to the shape of the conductive ceramic element 10 (FIG. 2). A compound 33 of conductive ceramic powder and binder is then injected into the cavity 32, thereby forming an integral injection compact 35, which includes the electrode materials 30 and a U-shaped conductive ceramic compact 34 (FIG. 4B).

Figure 5A:
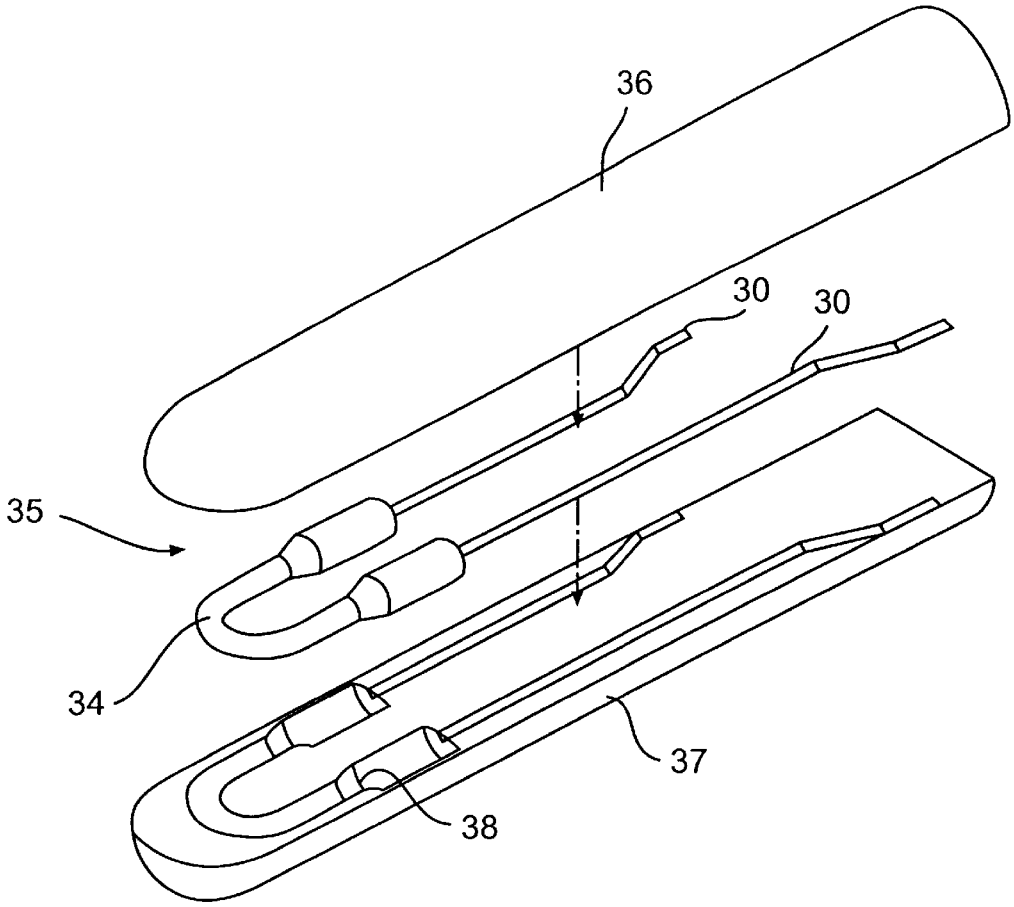
FIG. 5A is a perspective exploded view showing a preliminary assembly to be formed into a composite compact shown in FIG. 5B.
Figure 5B:
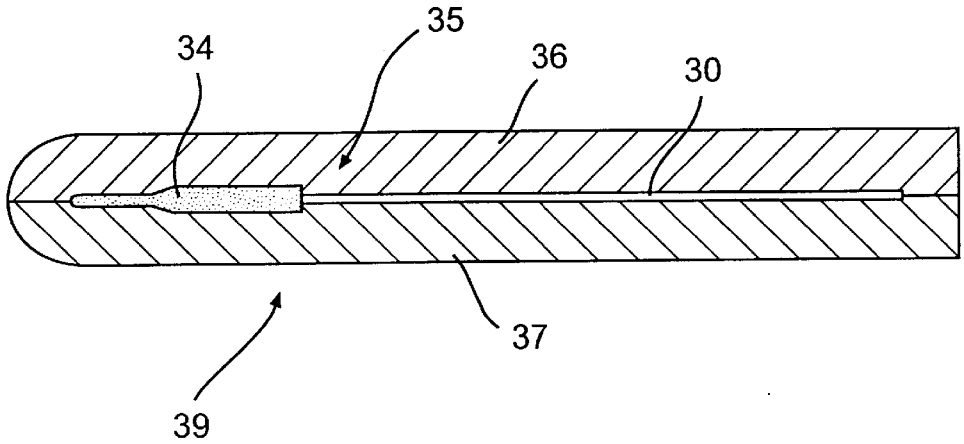
FIG. 5B is a sectional view showing the composite compact formed by pressing the preliminary assembly of FIG. 5A.

Meanwhile, as shown in FIG. 5A, preliminary compacts 36 and 37 to be formed into the ceramic body 13 (FIG. 2) are prepared through compaction of a material ceramic powder. The preliminary compacts 36 and 37 correspond to longitudinally halved portions of the ceramic body 13 (FIG. 2). Grooves 38 whose shape corresponds to the shape of the integral injection compact 35 are formed on the mating faces of the preliminary compacts 36 and 37. The preliminary compacts 36 and 37 are joined together while the integral injection compact 35 is held in the grooves 38. The thus-obtained assembly is pressed into a composite compact 39 as shown in FIG. 5B.

Figure 6A:
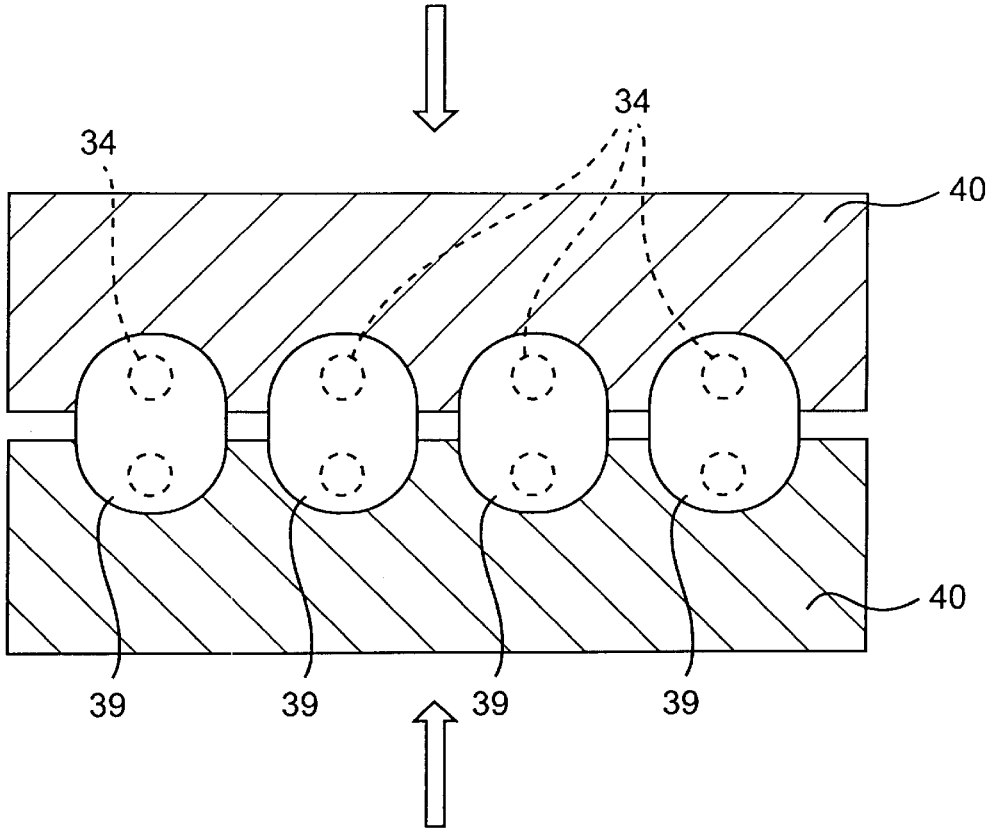
FIG. 6A is a sectional view depicting a step of hot pressing and firing.
Figure 6B:
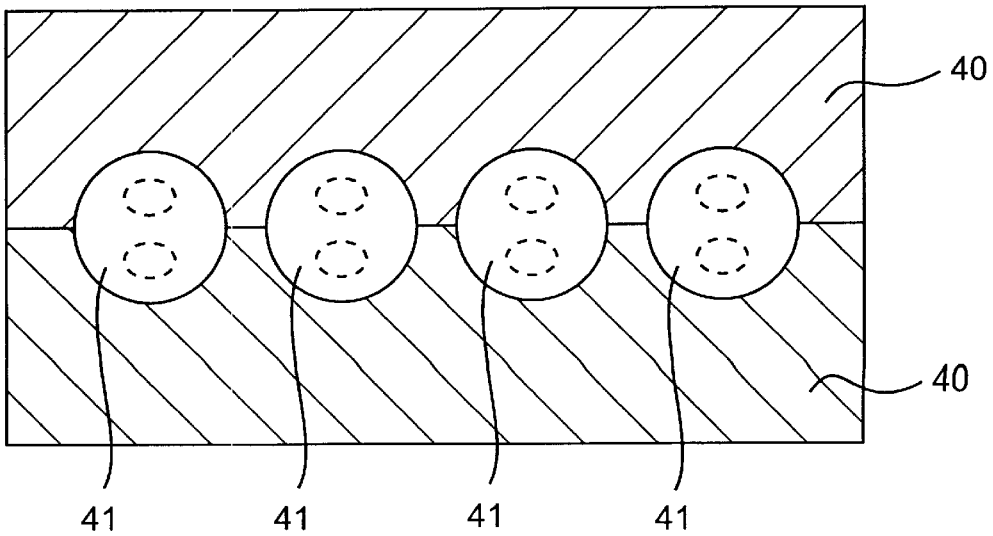
FIG. 6B is a sectional view showing fired bodies obtained through hot pressing and firing of FIG. 6A.
Figure 7B:
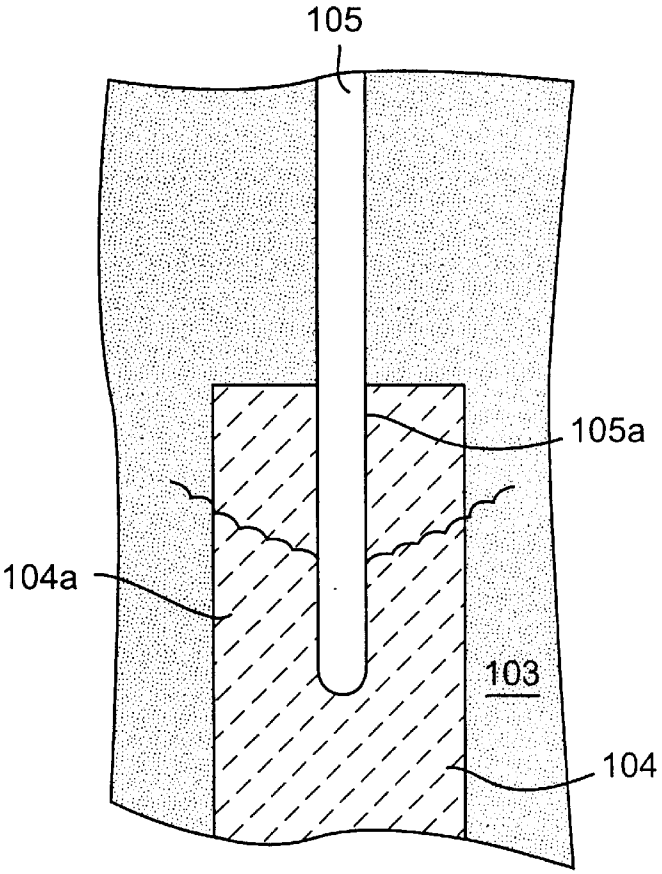
FIG. 7B PRIOR ART
FIG. 7B is a schematic view showing appearance of cracks in a conductive ceramic element of the conventional ceramic heater of FIG. 7A.
Figure 7A:
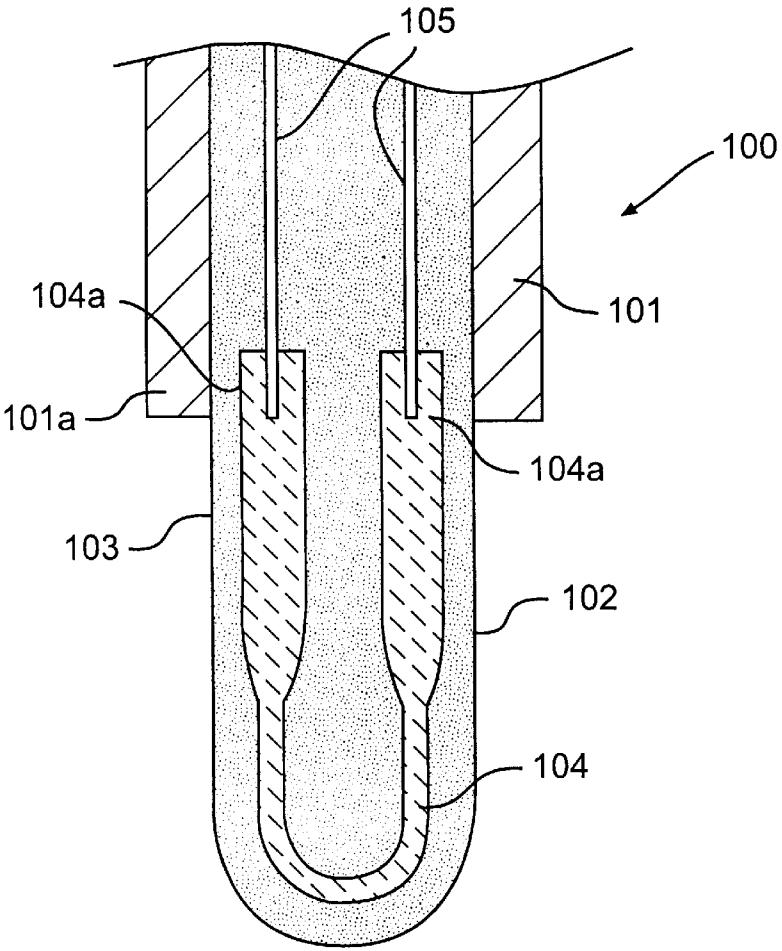
FIG. 7A PRIOR ART
FIG. 7A is a sectional partial view showing a conventional ceramic heater.

The composite compact 39 is next preliminarily fired in order to remove a binder component from the conductive ceramic compact 34 and from the preliminary compacts 36 and 37. As shown in FIG. 6A, the composite compact 39 is then hot-pressed and fired at a predetermined temperature by use of hot-pressing dies 40 of, for example, graphite, yielding a fired body 41 as shown in FIG. 6B. Thus, the conductive ceramic compact 34 is formed into the conductive ceramic element 10 the preliminary compacts 36 and 37 are formed into the ceramic body 13 and the electrode materials 30 are formed into the electrodes 11 and 12 (FIG. 2). Subsequently, the surface of the fired body 41 undergoes further treatment. For example, the surface is polished as needed, yielding the ceramic heating member 1 as shown in FIG. 2.

EXAMPLES

In order to confirm the effect of the present invention, the following ceramic heater samples were subjected to a durability test.

The conductive ceramic element 10 was made of tungsten carbide (WC), molybdenum silicide ($MoSi_2$ or $Mo_5Si_3$), or a composite of tungsten carbide and silicon nitride ($Si_3N_4$). The electrodes 11 and 12 were made of tungsten (W). The ceramic body 13 was made of silicon nitride ($Si_3N_4$). Through use of these elements, ceramic heaters having different distances between the end of the seat surface of the metallic shell and the end of the electrode 11 (12) were manufactured.

Voltage was applied to these ceramic heaters and regulated so that the maximum surface temperature of the ceramic heaters reached approximately 1400° C. The ceramic heaters were then subjected to a durability test, in which electricity was repeatedly cycled on and off at 1 minute intervals. The criteria for judging the durability of the ceramic heaters were as follows:

(C): not acceptable—the ceramic body cracked after operation of not greater than 10000 cycles;

(B): good—the ceramic body cracked after operation of greater than 10000 cycles to 20000 cycles; and (A): excellent—the ceramic body did not crack after operation of not less than 20000 cycles.

The results of the test are shown in Table 1.

TABLE 1

| Sample | Distance L between end of seat surface and end of electrode (mm) | Cycles ($\times 10^3$) 2 4 6 8 10 12 14 16 18 20 | Result | Judgment |
|---|---|---|---|---|
| 1 | 4 | —C | Appearance of crack at 4000 cycles | C |
| 2 | 3 | ——C | Appearance of crack at 5000 cycles | C |
| 3 | 2 | ————C | Appearance of crack at 9000 cycles | C |
| 4 | 1 | ————————C | Appearance of crack at 16000 cycles | B |
| 5 | 0 | ————————————A | No crack at 20000 cycles | A |
| 6 | −1 | ————————————A | No crack at 20000 cycles | A |
| 7 | −2 | ————————————A | No crack at 20000 cycles | A |
| 8 | −3 | ————————————A | No crack at 20000 cycles | A |
| 9 | −4 | ————————————A | No crack at 20000 cycles | A |

As seen from the results in Table 1, good durability is obtained when the distance L between the end of the seat surface of the metallic shell and the end of the electrode is 1 mm. When the distance L is set less than or equal to 0 mm, excellent durability in excess of 20000 cycles is obtained.

Obviously, numerous modifications and variations of the present invention are possible in light of the above teachings. It is therefore understood that within the scope of the appended claims, the present invention may be practiced otherwise than as specifically described herein.

What is claimed is:

1. A ceramic heater comprising a metallic shell with a tip end, wherein said metallic shell has at its tip end a seat surface that abuts a structural body when said ceramic heater is attached to the structural body; and a ceramic heating member disposed within said metallic shell such that a tip end portion is projected from said metallic shell, said ceramic heating member comprising:

a ceramic body;

a conductive ceramic element embedded in said ceramic body and adapted to generate heat upon reception of electricity; and at least one electrode having an end embedded in an end of said conductive ceramic element, wherein said electrode is disposed such that a distance L between the end of the electrode embedded in said conductive ceramic element and the end of the seat surface of said metallic shell satisfies the expression $L \leqq 1$ mm, where the distance L is considered negative when the end of the electrode is located within said metallic shell.

2. A ceramic heater according to claim 1, wherein said conductive ceramic element has a direction-changing portion extending from one base end thereof and changing directions to extend to the other base end thereof and two straight portions extending in the same direction from the corresponding base ends of the direction-changing portion, said conductive ceramic element being disposed such that the direction-changing portion corresponds to the end portion of said ceramic heating member, and two electrodes connected to said conductive ceramic element such that one end of one electrode is embedded in one end of said conductive ceramic element, and one end of the other electrode is embedded in the other end of said conductive ceramic element.

3. A ceramic heater according to claim 2, further comprising a cylindrical member, which is interposed between said ceramic heating member and said metallic shell and is projected from the end of the seat surface of said metallic shell.

4. A ceramic heater according to claim 3, wherein the distance L is set so as to satisfy the expression $L \leqq 0$ mm.

5. A ceramic heater according to claim 4, wherein the end of said ceramic heating member is located at least 20 mm apart from the end of the seat surface of said metallic shell.

6. A ceramic heater according to claim 3, wherein the end of said ceramic heating member is located at least 20 mm apart from the end of the seat surface of said metallic shell.

7. A ceramic heater according to claim 2, wherein the distance L is set so as to satisfy the expression $L \leqq 0$ mm.

8. A ceramic heater according to claim 7, wherein the end of said ceramic heating member is located at least 20 mm apart from the end of the seat surface of said metallic shell.

9. A ceramic heater according to claim 2, wherein the end of said ceramic heating member is located at least 20 mm apart from the end of the seat surface of said metallic shell.

10. A ceramic heater comprising a metallic shell with a tip end, wherein said metallic shell has at its tip end a seat surface that abuts a structural body when said ceramic heater is attached to the structural body, said ceramic heater further comprising a ceramic heating member disposed within said metallic shell such that a tip end portion is projected from said metallic shell, said ceramic heating member comprising:

a ceramic body;

a conductive ceramic element embedded in a portion of said ceramic body corresponding to the end portion of said ceramic heating member and including a direction-changing portion extending from one base end thereof and changing directions to extend to the other base end thereof and two straight portions extending in the same direction from the corresponding base ends of the direction-changing portion, said conductive ceramic element being disposed such that the direction-changing portion corresponds to the end portion of said ceramic heating member; and two electrodes connected to said conductive ceramic element such that one end of one electrode is embedded in one end of said conductive ceramic element, and one end of the other electrode is embedded in the other end of said conductive ceramic element, such that upon application of electricity to said conductive ceramic element through said electrodes, said conductive ceramic element generates heat through electrical resistance, wherein said electrodes are disposed such that a distance L between the ends of the electrodes embedded in said conductive ceramic element and the end of the seat surface of said metallic shell is set so as to satisfy an expression $L \leqq 1$ mm, where the distance L is considered negative when the ends of the electrodes are located within said metallic shell.

11. A ceramic heater according to claim 10, further comprising a cylindrical member which is interposed between said ceramic heating member and said metallic shell and is projected from the end of the seat surface of said metallic shell.

12. A ceramic heater according to claim 11, wherein the distance L is set so as to satisfy the expression $L \leqq 0$ mm.

13. A ceramic heater according to claim 12, wherein the end of said ceramic heating member is located at least 20 mm apart from the end of the seat surface of said metallic shell.

14. A ceramic heater according to claim 11, wherein the end of said ceramic heating member is located at least 20 mm apart from the end of the seat surface of said metallic shell.

15. A ceramic heater according to claim 10, wherein the distance L is set so as to satisfy the expression $L \leqq 0$ mm.

16. A ceramic heater according to claim 15, wherein the end of said ceramic heating member is located at least 20 mm apart from the end of the seat surface of said metallic shell.

17. A ceramic heater according to claim 10, wherein the end of said ceramic heating member is located at least 20 mm apart from the end of the seat surface of said metallic shell.

* * * * *